United States Patent [19]

Sizemore, Jr.

[11] Patent Number: 4,472,879

[45] Date of Patent: Sep. 25, 1984

[54] ADJUSTABLE MULTI-PURPOSE KNIFE STRUCTURE

[76] Inventor: Herbert H. Sizemore, Jr., 107 W. Martin, P.O. Box 677, McPherson, Kans. 67460

[21] Appl. No.: 209,339

[22] Filed: Nov. 24, 1980

[51] Int. Cl.[3] ..... B26B 3/00

[52] U.S. Cl. ..... 30/304; 30/287; 30/320

[58] Field of Search ..... 30/304, 340, 286, 287, 30/288, 299, 320, 279 R, 283; 81/DIG. 3, 165, 170

[56] References Cited

U.S. PATENT DOCUMENTS

| | | | |
|---|---|---|---|
| 1,148,410 | 7/1915 | Smith et al. | 81/DIG. 3 |
| 1,414,839 | 5/1922 | Stuarts | 81/210 |
| 1,877,211 | 9/1932 | Webster | 30/304 |
| 2,134,839 | 11/1938 | Perkins | 30/287 |
| 3,270,368 | 9/1966 | Cook, Sr. et al. | 30/304 X |

*Primary Examiner*—James G. Smith
*Assistant Examiner*—Debra S. Meislin
*Attorney, Agent, or Firm*—Phillip A. Rein

[57] ABSTRACT

This invention is an adjustable multi-purpose knife structure operable to fillet fish and cut selected thickness of meat, cheese, or the like. The adjustable multi-purpose knife structure includes first and second handle and blade assemblies interconnected by a connector and guide assembly and movable relative to each other by an actuator assembly. Each handle and blade assembly includes a blade member secured to a handle member. The connector and guide assembly includes spaced guide pin members operably connected to the adjacent first and second handle and blade assemblies to control the respective lateral movement thereof. The actuator assembly includes an actuator wheel assembly connected to and mounted between the first and second handle and blade assemblies and an actuator lock assembly mounted in one of the handle members. The actuator wheel assembly includes an actuator member that is rotatable to selectively move the first and second handle and blade assemblies toward or away from each other. The actuator lock assembly includes a lock member selectively engagable with the actuator member to prevent rotation thereof to lock the first and second handle and block assemblies in a selected spaced relationship. Numerous types of blade members may be provided depending on the desired cutting operation to be performed.

16 Claims, 10 Drawing Figures

FIG. 1
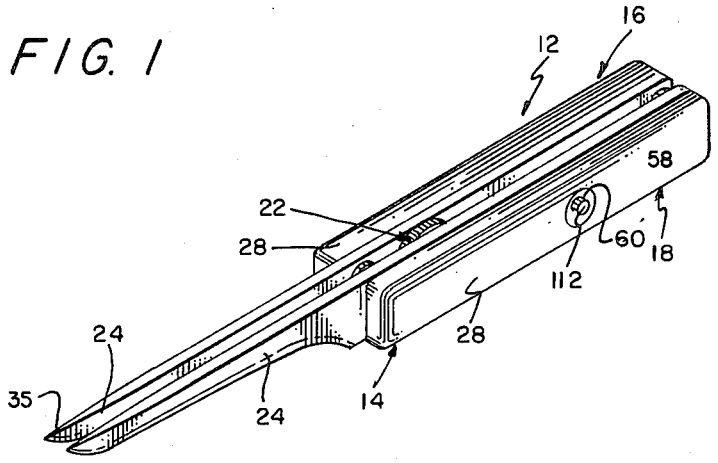
FIG. 2
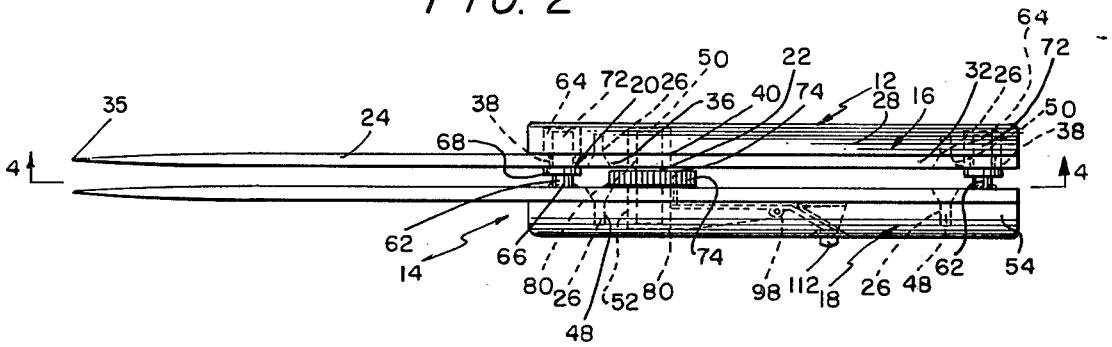
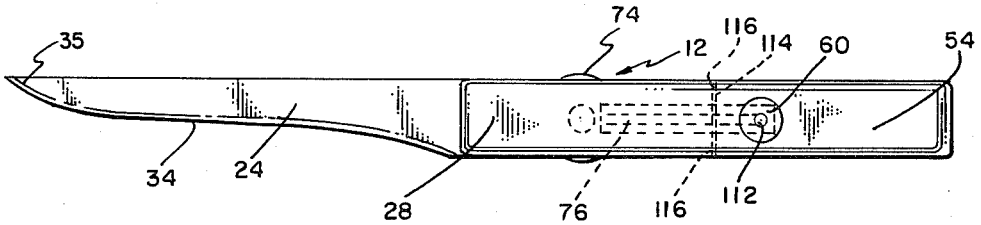
FIG. 3

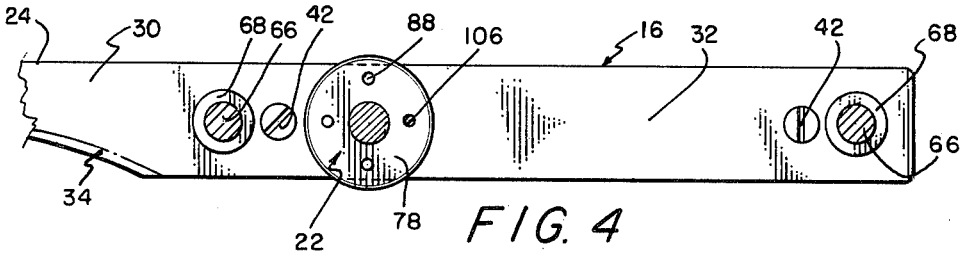
FIG. 4
FIG. 5
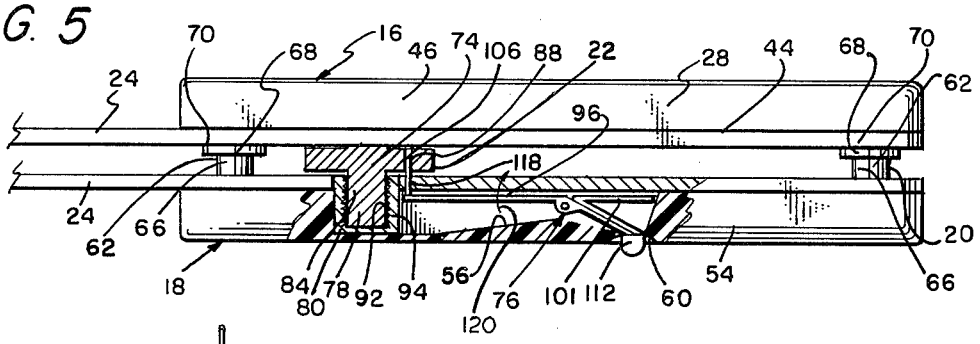
FIG. 6
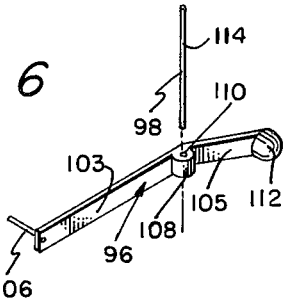
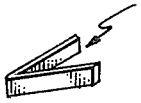
FIG. 7
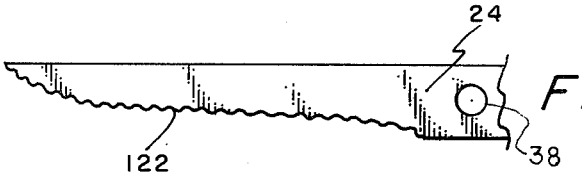
FIG. 8
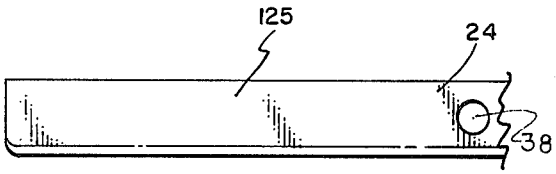
FIG. 9
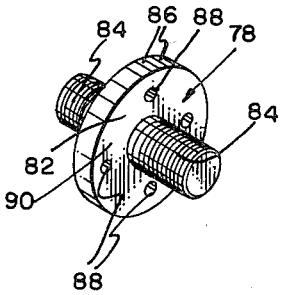
FIG. 10

ADJUSTABLE MULTI-PURPOSE KNIFE STRUCTURE

PRIOR ART

A search of the prior art revealed the following U.S. patents.

| | | |
|---|---|---|
| 1,814,528 | 2,348,429 | 3,270,368 |
| 1,847,062 | 2,397,875 | 3,381,807 |
| 1,877,211 | | |

The basic concept of using two or more knife blades is shown in the above identified patents. The Webster patent teaches the use of three spaced blades but uses a complex mechanism to move the blades.

However, none of the references teach the use of the applicant's connector and guide assembly or actuator assembly to selectively and adjustably space two adjacent blade members and lock in a desired position.

PREFERRED EMBODIMENT OF THE INVENTION

In one preferred embodiment of the invention, an adjustable multi-purpose knife structure includes a handle and blade assembly or means with first and second handle and blade assemblies interconnected by a connector and guide assembly and movable by an actuator assembly. Each of the first and second handle and blade assemblies includes a blade member secured by anchor members to one side of a handle member. The connector and guide assembly includes a pair of spaced guide pin members secured to one handle member and mounted in guide sleeve members secured to the other adjacent handle member. The connector and guide assembly assures parallel controlled lateral movement of the first and second handle and blade assemblies. The actuator assembly includes an actuator wheel assembly connected to and mounted between the first and second handle and blade assemblies and an actuator lock assembly secured to a handle member. The lock assembly includes a lock member engagable with the actuator wheel assembly to lock the first and second handle and blade assemblies in a given spaced position.

OBJECTS OF THE INVENTION

One object of this invention is to provide an adjustable multi-purpose knife structure having rigid, spaced knife blades to fillet a fish or the like with conformity of slices.

Another object of this invention is to provide an adjustable multi-purpose knife structure having spaced first and second knife members and an actuator assembly operable to move the knife members laterally of each other and lock in a selected, spaced relationship.

One other object of this invention is to provide an adjustable multi-purpose knife structure with spaced knife members that are rigidly interconnected so as to not be flexible when used but movable by an actuator assembly to a desired spaced position.

A further object of this invention is to provide an adjustable multi-purpose knife structure with different types of interchangable knife blades for different cutting operations.

Still, one other object of this invention is to provide an adjustable multi-purpose knife structure that is rigid in construction; safe to use; and flexible in use.

Various other objects, advantages, and features of the invention will become apparent to those skilled in the art from the following discussion, taken in conjunction with the accompanying drawings, in which:

FIGURES OF THE INVENTION

FIG. 1 is a perspective view of the adjustable multi-purpose knife structure of this invention;

FIG. 2 is a top plan view of the invention;

FIG. 3 is a side elevational view of the invention with portions shown in dotted lines for clarity;

FIG. 4 is a fragmentary sectional view taken along line 4—4 in FIG. 2;

FIG. 5 is an enlarged fragmentary top plan view with portions broken away to show an actuator assembly;

FIG. 6 is an exploded perspective view of a portion of an actuator lock assembly of the actuator assembly shown in FIG. 5;

FIG. 7 is a perspective view of a bias member of the actuator lock assembly;

FIG. 8 is a fragmentary side elevational view showing a serrated blade edge;

FIG. 9 is a fragmentary side elevational view showing a rectangular guide blade member; and FIG. 10 is an enlarged perspective view of an actuator member of the actuator assembly of this invention.

The following is a discussion and description of preferred specific embodiments of the new adjustable multi-purpose knife structure of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail and, in particular, to FIG. 1, an adjustable multi-purpose knife structure, indicated generally at 12, is used to fillet fish, steak; cut bread, cheese, etc. As will become obvious, the adjustable multi-purpose knife structure 12 is used to accurately slice a material to a preselected thickness.

The adjustable multi-purpose knife structure 12 includes a handle and blade assembly or means 14 having first and second handle and blade assemblies 16, 18, interconnected by a connector and guide assembly 20 and movable laterally by an actuator assembly 22.

The first handle and blade assembly 16 includes a blade member 24 secured as by anchor members 26 to a handle member 28. The blade member 24 can be of different types but is of the conventional razor edge as shown in FIGS. 1–3. The blade member 24 includes a cutting section 30 integral with a support section 32. The cutting section 30 is formed with a sharp edge 34 tapered outwardly to a point 35.

The support section 32 is preferrably of a rectangular shape to conform to the outline of the handle member 28 for maximum support. The support section 32 is provided with spaced anchor holes 36; spaced guide holes 38; and an actuator hole 40.

The anchor members 26 are preferrably screw members 42 extended through the anchor holes 36 and secured to the handle member 28 as shown in FIG. 2.

The handle member 28 is of rectangular block shape with an inner side 44 secured against the support section 32 by the anchor members 26 The handle member 28 includes a main body 46 having anchor holes 48; guide holes 50; and an actuator hole 52 therein aligned with the similar openings in the support section 32.

The second handle and blade assembly 18 is substantially identical to the first handle and blade assembly 16 with the blade member 24 secured by anchor members 26 to a different handle member 54.

The handle member 54 has the same anchor holes 48 and actuator hole 52 plus having an actuator housing indentation 56 in the main body 46. (FIG. 5) An outer surface 58 of the handle member 54 has a tapered opening 60 to receive a portion of the actuator assembly 22 as will be explained.

The connector and guide assembly 20 includes a pair of spaced guide pin members 62 secured as by welding to the blade member 24 of the second handle and blade assembly 18 and a pair of guide sleeve members 64 mounted in the respective guide holes 38 and 50 of the first handle and blade assembly 16.

The guide pin members 62 each include a main shaft section 66 with an abutment disc 68 secured to a central portion. Each abuttment disc 68 has a contact surface 70 in a common plane so as to receive the blade member 24 of the first handle and blade assembly 16 thereagainst as noted in FIG. 2.

The guide sleeve members 64 are of a circular tube shape adapted to receive an end portion 72 of respective ones of the main shaft sections 66 therein in a close fit situation to assure aligned, lateral movement of the first and second handle and blade assemblies 16, 18 in a manner to be explained.

The actuator assembly 22 includes an actuator wheel assembly 74 and an actuator lock assembly 76. The actuator wheel assembly 74 includes a central actuator member 78 mounted in connector members 80 which, in turn, are inserted in respective actuator holes 40, 52 of the first and second handle and blade assemblies 16, 18.

The actuator member 78 is formed with a central, circular control section 82 having threaded connector sections 84 extended from opposite sides of the control section 82. The control section 82 is of disc shape having serrations 86 on an outer surface thereof and spaced lock holes 88 on a main body 90 for engagement with the actuator lock assembly 76 as will be explained. The control section 82 is of a diameter slightly greater than the width of the handle members 28 so as to be easily rotated by one's thumb and not in the way during a cutting operation.

The threaded connector sections 84 are formed with opposite left and right hand threads for reasons to become obvious.

The connector members 80 are of a cup shape with internal threads 92 to receive outer threads 94 of respective ones of the connector sections 84. Due to the left and right hand threads of the connector sections 84, rotation of the actuator member 78 causes the first and second handle and blade assemblies 16, 18 to move laterally of each other either closer or further away depending on direction of movement of the control section 82. The connector and guide assembly 20 assures controlled, parallel relative movement of the first and second handle and blade assemblies 16, 18.

As best seen in the combination of FIGS. 5, 6, and 7, the actuator lock assembly 76 includes a lock member 96 rotatively mounted on a connector member 98 and a bias member 101 operably connected to the lock member 96.

The lock member 96 is of irregular shape having a central portion 103 integral at one end to an inclined actuator portion 105 and integral at the other end to a lock pin 106. The junction of the central portion 103 and actuator portion 105 is formed with a connector hub 108 having a hole 110 to receive the connector member 98 therein.

An outer end of the actuator portion 105 is formed with an actuator button 112 for operation there as will be explained.

The connector member 98 is a support shaft 114 that is inserted in the hole 110 in the connector hub 108. Opposite ends of the support shaft 114 are mounted in aligned holes 116 in the handle member 54 of the second handle and blade assembly 18 as noted in FIG. 2. This allows pivotal movement of the lock member 96 about the support shaft 114 to remove and insert the lock pin 106 through a hole 118 in the blade member 24 of the second handle and blade assembly 18 into a respective one of the lock holes 88.

The lock pin 106 resembles a lock shaft and, when inserted in one of the lock holes 88, prevents rotation of the actuator wheel assembly 74 and subsequent relative movement of the first and second handle and blade assemblies 16, 18.

The bias member 101 is of a V-shape, leaf spring type that is inserted between the actuator portion 105 of the lock member 96 and adjacent surface of the blade member 24. (FIG. 5) It is obvious that the bias member 101 urges the lock member 96 about the support shaft 114 in the direction of an arrow 120 toward the locked position.

As noted in FIG. 8, the blade member 24 can be formed with a serrated cutting edge 122 which is useful in sawing type cutting operations or the like.

Also, as noted in FIG. 9, one of the blade members 24 may be of rectangular shape and larger than the other blade member 24 which may be of a serrated or razor edge type. The rectangular shape has a main body 125 of larger size than the other blade members 24 so as to abut the material to be cut to assure a guiding and spacing function to achieve uniformed thickness of cut material.

USE AND OPERATION OF THE INVENTION

In the use and operation of the adjustable multi-purpose knife structure 12 of this invention, it is normally conveyed in the closed, compact condition as shown in FIGS. 1, 2, and 3. The actuator button 112 can be depressed as by one's thumb to pivot the lock member 96 about the support shaft 114 to remove the lock pin 106 from a respective lock hole 88. This permits rotation of the actuator wheel assembly 74 which rotation causes lateral, outward relative movement of the first and second handle and blade assemblies 16, 18.

The rotation of the actuator wheel assembly 74 is continued to achieve a desired spaced, parallel relationship of the adjacent blade members 24. Then, the actuator button 112 is released and the actuator wheel assembly 74 rotated slowly until the lock pin 106 drops into one of the four spaced lock holes 88. It is obvious that the bias member 101 urges the lock pin 106 into a respective one of the lock holes 88.

The adjustable multi-purpose knife structure 12 can now be used to fillet fish, steaks, cut breads and cheese, and other functions requiring a controlled cutting action to achieve uniform cut slices of material.

Also, the actuator wheel assembly 74 can be rotated to an extreme to fully separate the first and second handle and blade assemblies 16, 18 for ease of cleaning thereof.

The first and second handle and blade assemblies 16, 18 may be formed with blade members 24 of the razor edge type, serrated cuttine edge type, or of the rectangular plate type depending on intended use. The blade members 24 can be readily interchanged as desired on removal of the respective screw or anchor members 26.

It is seen that the adjustable multi-purpose knife structure of the invention is rigid in construction; easy to disassemble and clean; ready to adjust and lock in a usage position; and relatively safe in operation. The adjustable multi-purpose knife structure is constructed of high quality, close tolerance parts to assure rigidity and accurate cutting results.

While the invention has been described in conjunction with preferred specific embodiments thereof, it will be understood that this description is intended to illustrate and not to limit the scope of the invention, which is defined by the following claims:

I claim:

1. An adjustable multi-purpose knife structure adapted to fillet fish and the like, comprising:

(a) a handle and blade means having spaced first and second handle and blade assemblies;

(b) a connector and guide assembly operably connected to said first and second handle and blade assemblies to assure relative, lateral parallel movement therebetween;

(c) each of said first and second handle and blade assemblies having a blade member directly secured to a handle member;

(d) an actuator assembly mounted between and connected to said handle members; and (e) said actuator assembly having an actuator member mounted between said handle members and rotatable to move said blade members laterally of each other in a parallel relationship for desired cutting purposes.

2. An adjustable multi-purpose knife structure as described in claim 1, wherein:

(a) said actuator assembly includes an actuator lock assembly releasably connectable to said actuator member to hold same in a desired position to prevent lateral movement of said blade members.

3. An adjustable multi-purpose knife structure as described in claim 1, wherein:

(a) said actuator member having a central control section with connector sections which extend laterally of said control section;

(b) each of said connector sections mounted in respective adjacent said handle members; and (c) said central control section is rotatable to conjointly move said first and second handle and blade assemblies relative to each other.

4. An adjustable multi-purpose knife structure as described in claim 3, wherein:

(a) said central control section of a size to present an actuator surface above a top edge of said handle members, whereby said actuator surface can be engaged by one's thumb to rotate said actuator member to move said first and second handle and blade assemblies.

5. An adjustable multi-purpose knife structure as described in claim 1, wherein:

(a) said actuator lock assembly includes a lock member having a lock pin engagable with said actuator member and a bias member operable to urge said lock member into engagement with said actuator member.

6. An adjustable multi-purpose knife structure as described in claim 1, wherein:

(a) said connector and guide assembly includes a guide pin member secured to one of said handle members and a guide sleeve member secured to the other one of said handle members; and (b) said guide pin member slidably mounted in said guide member and movable axially thereof to assure parallel, lateral relative movement of said first and second handle and blade assemblies.

7. An adjustable multi-purpose knife structure as described in claim 1, wherein:

(a) said connector and guide assembly includes a pair of spaced guide pin members and cooperating spaced guide sleeve members mounted in said handle members; and (b) said guide pin members slidably mounted in said guide sleeve members to assure parallel lateral relative movement of said blade members for a controlled, adjustable cutting action.

8. An adjustable multi-purpose knife structure as described in claim 1, wherein:

(a) said actuator member having a central control section with connector sections extended laterally from each side of said central control section;

(b) said actuator assembly includes a connector member mounted in each of said handle members with said connector sections mounted in a respective one of said connector members; and (c) said central control section rotatable about a central axis to move said handle members in a parallel, lateral manner relative to each other.

9. An adjustable multi-purpose knife structure as described in claim 8, wherein:

(a) said connector sections formed with opposite threads to achieve conjoint movement of said first and second handle and blade assemblies toward or away from each other depending on direction of rotation of said actuator member.

10. An adjustable multi-purpose knife structure as described in claim 8, wherein:

(a) said actuator assembly includes an actuator lock assembly having a lock member engagable with said central control section to prevent rotation of said actuator member to prevent relative movement of said first and second handle and blade assemblies.

11. An adjustable multi-purpose knife structure as described in claim 10, wherein:

(a) said lock member pivotally mounted in an indentation in one of said handle members; and (b) said lock member having a lock pin engagable with a lock hole in said central control section to selectively prevent rotation of said actuator member.

12. An adjustable multi-purpose knife structure as described in claim 11, wherein:

(a) said lock member having an actuator portion extended laterally of said handle member;

whereby said actuator portion is moved to remove said lock pin from said lock hole to allow relative movement of said first and second handle and blade assemblies.

13. An adjustable multi-purpose knife structure as described in claim 11, wherein:

(a) said actuator lock assembly includes a bias member engagable with said lock member to urge same into the locked position.

14. An adjustable multi-purpose knife structure as described in claim 13, wherein:

(a) said bias member is a leaf spring member.

15. An adjustable multi-purpose knife structure as described in claim 1, wherein:

(a) said blade members formed with a serrated cutting edge adapted to saw through bones.

16. An adjustable multi-purpose knife structure as described in claim 1, wherein:

(a) one of said blade members is of a rectangular shape to form an abutting surface to cut breads and cheese.

* * * * *